United States Patent [19]

Bechstedt

[11] 4,268,262

[45] May 19, 1981

[54] CLEAR, COLD-STABLE LIQUID WASHING AGENT CONCENTRATES

[75] Inventor: Wolfgang Bechstedt, Dusseldorf-Garath, Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 86,478

[22] Filed: Oct. 19, 1979

[30] Foreign Application Priority Data

Nov. 2, 1978 [DE] Fed. Rep. of Germany ..... 2847438

[51] Int. Cl.[3] ..... C11D 9/08; C11D 10/04; C11D 17/08; C11D 9/30

[52] U.S. Cl. ..... 8/137; 252/108; 252/118; 252/121; 252/122; 252/153; 252/156; 252/158; 252/173; 252/174.21; 252/543

[58] Field of Search ..... 252/108, 118, 121, 122, 252/156, 158, 153, 173, DIG. 14; 8/137

[56] References Cited

U.S. PATENT DOCUMENTS

| | | | |
|---|---|---|---|
| 2,097,737 | 11/1937 | Pickett | 252/118 |
| 2,792,347 | 5/1957 | Stegemeyer | 252/108 |
| 4,065,398 | 12/1977 | Brouwer | 252/108 |
| 4,079,078 | 3/1978 | Collins | 252/545 |

FOREIGN PATENT DOCUMENTS

| | | | |
|---|---|---|---|
| 2609752 | 9/1977 | Fed. Rep. of Germany | 252/118 |
| 1116966 | 6/1968 | United Kingdom | 252/118 |

*Primary Examiner*—Dennis L. Albrecht
*Attorney, Agent, or Firm*—Hammond & Littell, Weissenberger and Muserlian

[57] ABSTRACT

A clear, cold-stable liquid washing agent concentrate consisting essentially of:

(A) from 22.5% to 35% by weight of a potassium soap of fatty acids having 12 to 18 carbon atoms and a melting point of below 55° C., (B) from 5% to 9% by weight of an ethoxylated primary alcohol having 5 to 10 oxyethylene units, (C) from 4% to 10% by weight of a sodium $C_{10}$–$C_{14}$ alkylbenzenesulfonate, (D) from 0.05% to 1% by weight of at least one optical brightener, (E) from 0.1% to 5% by weight of potassium hydroxide.

(F) from 0 to 6% by weight of triethanolamine, (G) from 8% to 20% by weight of at least one $C_{1-3}$ alcohol, and (H) the remainder up to 100% of water, wherein the amount of water is at least 30% by weight and the concentration of the total of components (A) to (E) does not exceed 50% by weight of the concentrate.

The washing agent concentrate can be employed in all type of washings of textiles in soft or hard waters, preferably in amounts of from 3 to 10 gm per kg of dry wash.

12 Claims, No Drawings

CLEAR, COLD-STABLE LIQUID WASHING AGENT CONCENTRATES

BACKGROUND OF THE INVENTION

This invention relates to clear, cold-stable liquid washing agent concentrates, particularly for washing textiles, containing potassium soaps, nonionic tensides, sulfonates and optical brighteners.

It is well known that the preparation of clear, aqueous washing agent concentrates that do not dissociate or solidify at low temperatures, particularly from below the freezing point to −10° C., presents considerable problems. This applies especially to concentrates that contain soap and have a content of active substance of 50% by weight and more. Additional difficulties can occur when such agents contain optical brighteners. Phase separations or precipitates caused by low temperatures or freezing of the solutions frequently are irreversible, even after reheating. Either further dilution of the solutions or the use of larger quantities of organic solvents can be employed to meet such problems, but dilute solutions require more packing and transport volume, while large amounts of organic solvents introduce problems because of the higher costs and greater flammability associated with them.

German Published Application DE-OS 26 09 752, by which these problems are largely solved, describes a clear, liquid washing agent concentrate that is unaffected by cold, with a solids content of up to 55% by weight, containing 8% to 18% by weight of a potassium soap derived from fatty acids with 12 to 18 carbon atoms and consisting mainly of oleic acid, from 10% to 25% by weight of ethoxylated alcohols with 8 to 12 carbon atoms and an average of 5 to 10 ethylene glycol ether groups, as well as from 4% to 10% by weight of sodium alkylbenzenesulfonates with 10 to 14 carbon atoms in the alkyl group, from 0.05% to 1% of optical brighteners, and conventional solvents or solvents miscible with water, together with at least 45% of water.

Agents of this type are above all intended for use in large-scale laundries with automatic washing, drying and ironing equipment, in which the individual operations are joined into a continuous process. The composition of a washing agent suitable for this purpose must be formulated in such a manner that no disturbances occur that impair the functioning of the machines or interrupt the work rhythm. It has been observed with certain new automatic washing machines that the use of conventional washing agents and to a certain, but lesser, degree also the use of the agents according to DE-OS 26 09 752 reduces the necessary easy movability of the loading and unloading doors that move in grooves, so that these no longer open and close in the proper rhythm. Furthermore, problems may arise during water extraction and hot-mangling. For example, wash compacted in self-centrifuging washing machines can be loosened with the wall of the drum only with additional labor, or problems may arise during the transporting and mangling of the washing.

OBJECTS OF THE INVENTION

An object of the invention was the solving to some extent problems of physical handling of the wash, through a change in the washing agent formula without having to forego the other advantageous properties of the washing agent, namely, clear solubility, homogenity and unlimited shelf life in the temperature range of between −10° C. and +40° C. and the perfect pumping, pouring and dosing qualities resulting therefrom.

Another object of the present invention is the development of a clear, cold-stable liquid washing agent concentrate consisting essentially of:

(A) from 22.5% to 35% by weight of a potassium soap of $C_{12-18}$-fatty acids having from 60% to 100% of the fatty acid of acids selected from the group consisting of $C_{12-14}$-alkanoic acids, oleic acid, and mixtures thereof, (B) from 5% to 9% by weight of an ethoxylate of from 5 to 10 ethoxylate units onto a primary alcohol selected from the group consisting of linear $C_{8-14}$-alkanols and $C_{8-14}$-2-methylated alkanols, (C) from 4% to 10% by weight of a sodium $C_{10-14}$-alkylbenzenesulfonate, (D) from 0.05% to 1% by weight of an alkali metal salt of substituted stilbenesulfonic acid optical brighteners, (E) from 0.1% to 5% by weight of potassium hydroxide, (F) from 0 to 6% by weight of triethanolamine, (G) from 8% to 20% by weight of alcohols selected from the group consisting of $C_{1-3}$-alkanols and mixtures of $C_{1-3}$-alkanols with up to 35% by weight of the mixture of hydrotropes selected from the group consisting of $C_{1-4}$-alkoxy-$C_{2-3}$-alkanols, $C_{1-4}$-alkoxy-$C_{2-3}$-alkoxy-$C_{2-3}$-alkanols and alkali metal salts of alkylbenzenesulfonates having from 1 to 2 alkyl groups with a total of 1 to 3 carbon atoms, and (H) the remainder up to 100% of water, where the amount of water is at least 30% by weight and the concentration of the total of components A to E does not exceed 50% by weight of the concentrate.

A further object of the present invention is the development of a method of washing soiled textiles employing the above clear, cold-stable liquid washing agent concentrate and softened water.

These and other objects of the invention will become more apparent as the description thereof proceeds.

DESCRIPTION OF THE INVENTION

The drawbacks of the prior art have been overcome and the above objects have been achieved in the development of the present invention.

The subject of the invention is a clear, liquid, aqueous washing agent concentrate with great stability in cold temperatures, characterized by a content of:

(A) from 22.5% to 35% by weight of a potassium soap of fatty acids with 12 to 18 carbon atoms and containing from 60% to 100% by weight of saturated fatty acids with 12 to 14 carbon atoms and/or oleic acid, (B) from 5% to 9% by weight of an ethoxylated, primary alkanol that is either linear or has methyl groups in the 2 position with 8 to 14 carbon atoms, and an average of 5 to 10 ethylene glycol ether groups, (C) from 4% to 10% by weight of a sodium alkylbenzenesulfonate with linear alkyl chains with 10 to 14 carbon atoms, (D) from 0.05% to 1% by weight of an optical brightener from the class of the substituted stilbenesulfonic acids in the form of the Na or K salt, (E) from 0.1% to 5% by weight of potassium hydroxide, (F) from 0 to 6% by weight of triethanolamine, (G) from 8% to 20% by weight of an alkanol with 1 or 3 carbon atoms, or a mixture of said alkanol with a hydrotrope of the type: alkyl ethers of alkanediols with 1 to 4 carbon atoms in the alkyl and 2 to 3 carbon atoms in the alkanediol or a $C_{1-3}$-alkylbenzenesulfonate, Na or K salt, and (H) the remainder up to 100% of water, with the concentration of the substances under (A) to (E) not exceeding a total of 50% by weight.

More particularly, the present invention relates to a clear, cold-stable liquid washing agent concentrate consisting essentially of:

(A) from 22.5% to 35% by weight of a potassium soap of $C_{12-18}$-fatty acids having from 60% to 100% of the fatty acid of acids selected from the group consisting of $C_{12-14}$-alkanoic acids, oleic acid, and mixtures thereof, (B) from 5% to 9% by weight of an ethoxylate of from 5 to 10 ethoxylate units onto a primary alcohol selected from the group consisting of linear $C_{8-14}$-alkanols and $C_{8-14}$-2-methylated alkanols, (C) from 4% to 10% by weight of a sodium $C_{10-14}$-alkylbenzenesulfonate, (D) from 0.05% to 1% by weight of an alkali metal salt of substituted stilbenesulfonic acid optical brighteners, (E) from 0.1% to 5% by weight of potassium hydroxide, (F) from 0 to 6% by weight of triethanolamine, (G) from 8% to 20% by weight of alcohols selected from the group consisting of $C_{1-3}$-alkanols and mixtures of $C_{1-3}$-alkanols with up to 35% by weight of the mixture of hydrotropes selected from the group consisting of $C_{1-4}$-alkoxy-$C_{2-3}$-alkanols, $C_{1-4}$-alkoxy-$C_{2-3}$-alkoxy-$C_{2-3}$-alkanols and alkali metal salts of alkylbenzenesulfonates having from 1 to 2 alkyl groups with a total of 1 to 3 carbon atoms, and (H) the remainder up to 100% of water, where the amount of water is at least 30% by weight and the concentration of the total of components A to E does not exceed 50% by weight of the concentrate.

The potassium soaps listed under A are derived from fatty acids of natural or synthetic origin, which contain from 60% to 100% by weight, preferably from 65% to 95% by weight, of lauric acid, myristic acid and/or oleic acid. Mixtures of lauric and myristic acid should contain at least one-half, preferably at least two-thirds, of lauric acid. Besides the mentioned acids, polyunsaturated fatty acids, such as linoleic acid, may be contained in proportions of from 0 to 25%, preferably from 0.1% to 15% by weight, in the fatty acids. The amount of the saturated fatty acids with 16 to 18 carbon atoms for the purpose of the invention is from 0 to not more than 20%, preferably 1% to 15%, by weight, with the proportion of stearic acid not to exceed 5% by weight and especially not 3% by weight. Suitable fatty acid mixtures have, for example, the following compositions (in % by weight):

(I)

50% to 95%, preferably 60% to 90%, lauric acid,
5% to 50%, preferably 10% to 40%, myristic acid,
0 to 10%, preferably 1% to 10%, palmitic acid,
0 to 5%, preferably 0.1% to 3%, stearic acid.

(II)

60% to 100%, preferably 65% to 95%, oleic acid,
0 to 25%, preferably 0.1% to 15%, linoleic acid,
0 to 40%, preferably 1% to 20%, lauric acid,
0 to 20%, preferably 1% to 10%, myristic acid,
0 to 10%, preferably 0.5% to 6%, palmitic acid,
0 to 5%, preferable 0.1% to 3%, stearic acid.

(III)

10% to 60%, preferably 25% to 50%, oleic acid,
40% to 70%, preferably 25% to 50%, lauric acid,
0 to 20%, preferably 5% to 25%, myristic acid,
0 to 10%, preferably 0.5% to 5%, palmitic acid,
0 to 5%, preferably 0.1% to 3%, stearic acid,
0 to 10%, preferably 0.1% to 10%, linoleic acid.

Particularly preferred are washing agents containing fatty acids of the composition II as a base. The potassium soaps of the fatty acids are employed in amounts of from 22.5% to 35% by weight, preferably from 25% to 30% by weight, of the concentrate.

The ethoxylated alcohols listed under B are derived from natural or synthetic alcohols, especially oxoalcohols with 8 to 14, preferably 9 to 12, carbon atoms. The oxoalcohols can be linear or have methyl groups in the 2 position. Mixtures of natural fatty alcohols and those obtained by oxo-reaction are also suitable. The average number of the ethylene glycol ether groups is 5 to 10, preferably 6 to 8. The content of ethoxylated alcohols in the liquid concentrates is from 5% to 9%, preferably from 6% to 8%, by weight of the concentrate.

Component C consists of sodium linear alkylbenzenesulfonate having from 10 to 14 carbon atoms in the alkyl, particularly dodecylbenzenesulfonate, in amounts of from 4% to 10%, preferably 6% to 8%, by weight of the concentrate.

The optical brighteners listed under D are alkali metal salts, preferably Na and K salts of substituted stilbenesulfonic acids and are derived from compounds of the formulas:

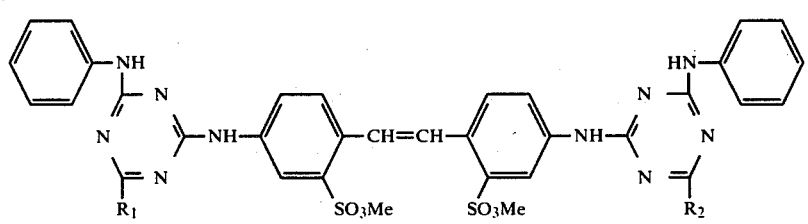

(I)

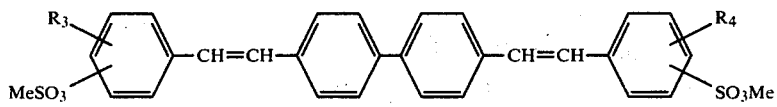

(II)

in which the individual symbols, Me, $R_1$, $R_2$, $R_3$ and $R_4$ have the following significance:

Me=Na, K $R_1$, $R_2$=—$NHCH_3$, —$NCH_3(CH_2CH_2OH)$, —$N(CH_2CH_2OH)_2$,

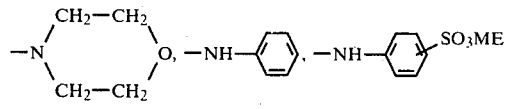

$R_3$, $R_4$=H, —$CH_3$, —Cl, —$OCH_3$, —$COOCH_3$, —CN, —$SO_2NR_5R_6$, —$CONR_5R_6$, with $R_5$ and $R_6$=H or alkyl having 1 to 3 carbon atoms.

Optical brighteners of Formula I, in which $R_1$ and $R_2$ represent morpholino, diethanolamino, or anilino radicals, are preferable. The optical brighteners of Component D are present in proportions of from 0.05% to 1%, preferably 0.1% to 0.7%, by weight of the concentrate.

Component E serves to make the solution or washing liquor alkaline. The potassium hydroxide is preferably used in such an amount that it exceeds the stoichiometric amount required for the formation of the potassium soap of fatty acids by 10 to 50 mol percent, especially by 20 to 35 mol percent. The potassium hydroxide is employed in amounts of from 0.1% to 5% by weight, preferably from 0.7% to 4% by weight, of the concentrate.

Triethanolamine (Component F) improves the concentrate's resistance to the cold is optionally present in proportions of up to 6% by weight, preferably 2% to 5% by weight, of the concentrate.

Component G consists of aliphatic $C_1$–$C_3$-alkanols, such as methanol, ethanol, propanol and particularly isopropanol, as well as of mixtures of the mentioned alkanols. Preferably the content of these alkanols in the concentrate is from 12% to 18% by weight. Washing agent concentrates with amounts of less than 12% by weight of the mentioned alkanols can also contain hydrotropic ether alcohols derived from $C_1$–$C_4$-monoalkanols and ethylene glycol or propylene glycol or diethylene glycol, or hydrotropic alkylbenzenesulfonates with 1 to 2 short alkyl chains and a total of 1 to 3 carbon atoms. Suitable are methoxyethanol, ethoxyethanol, propoxyethanol, isopropoxyethanol, or butoxyethanol, as well as from the group of the alkylbenzenesulfonates, toluenesulfonate, ethylbenzenesulfonate, cumenesulfonate and xylenesulfonate in the form of the potassium or preferably sodium salts. The proportion of these substances that improve the solubility can amount to up to 5% by weight of the concentrate. However, the amount of hydrotropes would amount to 35% or less of component G alkanols.

The water content in the washing agent concentrate should not be less than 30% by weight. No limits are given in the direction of a more dilute solution, but it is recommended that a water content of 55% not be exceeded for the sake of keeping the packaging and transport volume within limits. A water content of from 30% to 50% by weight is generally adequate to obtain optimal results. Such concentrates remain clear liquids even after several weeks of storage at a temperature of −10° C. and do not tend to solidify, congeal or dissociate under such extreme conditions.

Biocides, fragrances, dyes, stabilizers, sequestering agents, neutral salts and optical brighteners of another constitution than those specified may be present as further additives, but the proportion of such additives should not exceed a total of 10% by weight and preferably be less than 5% by weight, especially less than 2% by weight, of the concentrate, to avoid a negative influence on the stability of the concentrate in cold temperatures.

The washing agents according to the invention are used in an amount of from 3 to 10 gm per kg of dry wash, preferably with softened water. They are suitable as washing agents for the prewash or main wash cycle for textiles of all types including those of cellulose, synthetic and semisynthetic fibers. Preferred areas of use are in the fully automated washing, drying and ironing installations, and they are generally found in commercial, large-scale laundries.

In an additional form of application the agents can be added to increase the washing power of washing solutions of conventional composition containing tensides, or the concentrate can be employed with wash alkali concentrates that contain wash alkalies, phosphates, sequestering agents, bleaches and substances that inhibit greying. A liquid wash alkali concentrate particularly suitable for use in automated, large-scale laundries, with which the washing agent concentrate according to the invention can be combined, has the following composition:

0.5% to 5% by weight of sodium tripolyphosphate, 0 to 25% by weight of potassium tripolyphosphate, where the total amount of tripolyphosphates is preferably from 5% to 20% by weight, 0 to 10% by weight, preferably 1% to 5% by weight, of sodium silicate of the composition:

$Na_2O:SiO_2$-1:1 to 1:3.5, 0.5% to 5% by weight of sodium ethylenediaminetetraacetate, 0 to 25% by weight, preferably 5% to 22% by weight, of potassium hydroxide, the remainder to 100%, water. Preferably, the amount of water is sufficient to dissolve all the above constituents of the wash alkali concentrate at room temperature.

This is also a clear solution that is stable in cold temperatures and easy to dose. One to four parts by weight of the above wash alkali concentrate are used per 1 part by weight of the liquid washing agent concentrate according to the invention. These mixtures are particularly useful for the washing of heavily soiled work clothes.

The following examples are illustrative of the practice of the invention without being limitative in any respect.

EXAMPLES

The potassium soaps used in the formulations of the examples had the fatty acid composition given in Table 1 (in percent by weight).

TABLE 1

| | Soap $A_1$ | Soap $A_2$ | Soap $A_3$ |
|---|---|---|---|
| Lauric acid | 67.0 | 0.5 | 42.0 |
| Myristic acid | 26.0 | 1.5 | 14.5 |
| Palmitic acid | 3.6 | 5.7 | 2.8 |
| Stearic acid | 1.2 | 2.1 | 0.5 |
| Oleic acid | 2.2 | 82.0 | 40.0 |
| 9,12-Linoleic acid | — | 8.2 | 0.2 |

An oxoalcohol with the chain length $C_9$ to $C_{11}$ and seven ethylene glycol ether groups was used as the ethoxylated alcohol, Component B. Component C consisted of linear Na-dodecylbenzenesulfonate. The sodium salt of the compound according to Formula I was used as optical brightener (Component D), in which $R_1$ and $R_2$ represented morpholino radicals. Component G consisted of isopropanol. "Salts" are understood to mean small quantities of $Na_2SO_4$ and NaCl, which were present as accompanying substances of the alkylbenzenesulfonate and the optical brightener. The composition of Examples 1 to 6 are given in Table 2.

TABLE 2

| | Example | | | | | |
|---|---|---|---|---|---|---|
| | 1 | 2 | 3 | 4 | 5 | 6 |
| Soap $A_1$ | 29.5 | — | — | — | — | — |
| Soap $A_2$ | — | 28.4 | 28.4 | 28.4 | 28.4 | — |
| Soap $A_3$ | — | — | — | — | — | 26.5 |
| B | 8.0 | 7.0 | 7.0 | 7.0 | 7.0 | 8.5 |
| C | 7.0 | 7.0 | 7.0 | 7.0 | 7.0 | 7.5 |
| D | 0.5 | 0.5 | 0.5 | 0.5 | 0.5 | 0.5 |
| E | 1.5 | 1.0 | 1.0 | 1.0 | 3.5 | 1.2 |
| F | 4.0 | — | 5.0 | 3.5 | — | 4.0 |
| G | 16.0 | 18.0 | 15.0 | 12.0 | 12.0 | 12.0 |
| Salts | 0.5 | 0.5 | 0.5 | 0.5 | 0.5 | 0.5 |
| Water | 33.0 | 37.6 | 35.6 | 40.1 | 41.1 | 39.3 |

For the preparation of the washing agent concentrates, the soap (Component A) including the excess potassium hydroxide (Component E), in the form of a 65% aqueous paste, was first mixed with the ethoxylate (Component B) and the alkylbenzenesulfonate (Component C), present in the form of a 50% aqueous solution, then the optical brightener (Component D) dissolved in isopropanol (Component G) was stirred in and finally the triethanolamine (Component F) and water (Component H) were added to make up the specified amount.

The concentrates were yellowish, clear solutions that were thin liquids at room temperature, which remained clear and homogeneous after three weeks of storage in the climate chamber at −10° C. and +50° C. A repeated change of the temperature between +50° C. and −10° C. did not change the appearance and behavior of the samples. The concentrates were miscible with water at any ratio.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. A clear, cold-stable liquid washing agent concentrate consisting essentially of:

(A) from 25% to 30% by weight of a potassium soap of $C_{12-18}$-fatty acids having from 60% to 100% of the fatty acid of acids selected from the group consisting of $C_{12-14}$-alkanoic acids, oleic acid, and mixture thereof, wherein the amount of saturated $C_{16-18}$-fatty acids is from 1% to 15% by weight of the fatty acids and the amount of stearic acid does not exceed 3% by weight of the fatty acids, (B) from 5% to 9% by weight of an ethoxylate of from 6 to 8 ethoxylate units onto a primary alcohol selected from the group consisting of linear $C_{9-12}$-alkanols and $C_{9-12}$-2-methylated alkanols, (C) from 6% to 8% by weight of a sodium $C_{10-14}$-alkyl-benzenesulfonate, (D) from 0.1% to 0.7% by weight of an alkali metal salt of substituted stilbenesulfonic acid optical brighteners, (E) from 0.7% to 4% by weight of potassium hydroxide, (F) from 0 to 6% by weight of triethanolamine, (G) from 12% to 18% by weight of alcohols selected from the group consisting of $C_{1-3}$-alkanols and mixtures of $C_{1-3}$-alkanols with up to 35% by weight of the mixture of hydrotropes selected from the group consisting of $C_{1-4}$-alkoxy-$C_{2-3}$-alkanols, $C_{1-4}$-alkoxy-$C_{2-3}$-alkoxy-$C_{2-3}$-alkanols and alkali metal salts of alkylbenzenesulfonates having from 1 to 2 alkyl groups with a total of 1 to 3 carbon atoms, and (H) the remainder up to 100% of water, where the amount of water is from 30% to 50% by weight and the concentration of the total compounds A to E does not exceed 50% by weight of the concentrate.

2. The clear, cold-stable liquid washing agent concentrate of claim 1, wherein the fatty acids of the potassium soap component A consists of 65% to 95% by weight of oleic acid and does not contain more than 3% by weight of the fatty acids of stearic acid.

3. The clear, cold-stable liquid washing agent concentrate of claim 1, wherein the fatty acids of the potassium soap component A consists of 75% to 95% by weight of a mixture of lauric acid and myristic acid, of which at least half the mixture is lauric acid.

4. The clear, cold-stable liquid washing agent concentrate of claim 3 wherein at least two thirds of said mixture is lauric acid.

5. The clear, cold-stable liquid washing agent concentrate of claims 1, 2 or 3 wherein the ethoxylate component B is an ethoxylate of from 6 to 8 ethoxylate units onto a linear $C_{9-12}$-alkanol.

6. The clear, cold-stable liquid washing agent concentrate of claims 1, 2 or 3 wherein said component C is sodium dodecylbenzenesulfonate.

7. The clear, cold-stable liquid washing agent concentrate of claims 1, 2 or 3 wherein said optical brightener component D is a compound of the formula selected from the group consisting of

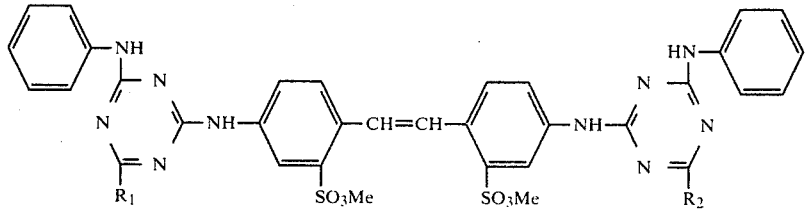

and

-continued

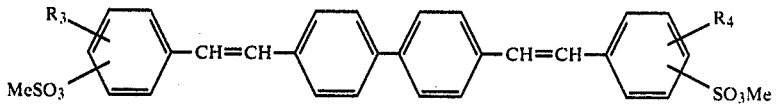

wherein Me is a member selected from the group consisting of sodium and potassium, $R_1$ and $R_2$ are members selected from the group consisting of $—NHCH_3$, $—NCH_3(CH_2CH_2OH)$, $—N(CH_2CH_2OH)_2$,

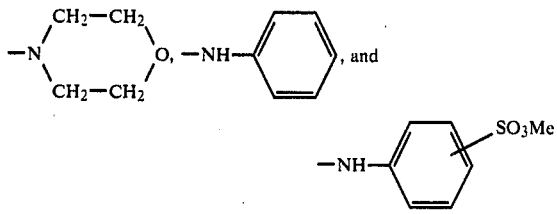

$R_3$ and $R_4$ are members selected from the group consisting of H, $—CH_3$, —CL, $—OCH_3$, $—COOCH_3$, —CN, $—SO_2NR_5R_6$, and $—CONR_5R_6$, $R_5$ and $R_6$ are members selected from the group consisting of hydrogen and alkyl having from 1 to 3 carbon atoms.

8. The clear, cold-stable liquid washing agent concentrate of claim 7 wherein $R_1$ and $R_2$ are members selected from the group consisting of morpholino, diethanolamino and anilino.

9. The clear, cold-stable liquid washing agent concentrate of claim 1 wherein the triethanolamine component F is present in an amount of from 2% to 5% by weight of the concentrate.

10. The clear, cold-stable liquid washing agent concentrate of claim 1, wherein said alcohol component G is isopropanol.

11. The clear, cold-stable liquid washing agent concentrate of claim 1 wherein the amount of water is from 30% to 50% by weight.

12. A method of washing soiled textiles consisting of the steps of adding a clear, cold-stable liquid washing agent concentrate consisting essentially of:

(A) from 22.5% to 35% by weight of a potassium soap of $C_{12-18}$-fatty acids having from 60% to 100% of the fatty acid of acids selected from the group consisting of $C_{12-14}$-alkanoic acids, oleic acid, and mixtures thereof, (B) from 5% to 9% by weight of an ethoxylate of from 5 to 10 ethoxylate units onto a primary alcohol selected from the group consisting of linear $C_{8-14}$-alkanols and $C_{8-14}$-2-methylated alkanols, (C) from 4% to 10% by weight of a sodium $C_{10-14}$-alkylbenzenesulfonate, (D) from 0.05% to 1% by weight of an alkali metal salt of substituted stilbenesulfonic acid optical brighteners, (E) from 0.1% to 5% by weight of potassium hydroxide, (F) from 0 to 6% by weight of triethaolamine, (G) from 8% to 20% by weight of alcohols selected from the group consisting of $C_{1-3}$-alkanols and mixtures of $C_{1-3}$-alkanols with up to 35% by weight of the mixture of hydrotropes selected from the group consisting of $C_{1-4}$-alkoxy-$C_{2-3}$-alkanols, $C_{1-4}$-alkoxy-$C_{2-3}$-alkoxy-$C_{2-3}$-alkanols and alkali metal salts of alkylbenzenesulfonates having from 1 to 2 alkyl groups with a total of 1 to 3 carbon atoms, and (H) the remainder up to 100% by water, where the amount of water is at least 30% by weight and the concentration of the total of components A to E does not exceed 50% by weight of the concentrate, to softened water containing soiled textiles in an automatic washer in such amounts that from 3 to 10 gm of said concentrate are present per kilo-gram of dry textiles, agitating said textiles in said concentrate-containing softened water, draining, rinsing and mangling said textiles and recovering clean textiles.

* * * * *